United States Patent [19]

Allred

[11] Patent Number: 4,934,109

[45] Date of Patent: Jun. 19, 1990

[54] METHOD AND APPARATUS FOR GRINDING THE EDGE OF A PIPE

[76] Inventor: Brody Allred, 420 Haven St., Lot 20, Eaton Rapids, Mich. 48827

[21] Appl. No.: 359,866

[22] Filed: Jun. 1, 1989

[51] Int. Cl.[5] ..... B24B 19/00

[52] U.S. Cl. ..... 51/241 S; 51/241 B; 51/290

[58] Field of Search ..... 51/281 R, 290, 281 SF, 51/241 S, 241 B, 170 T

[56] References Cited

U.S. PATENT DOCUMENTS

| | | | |
|---|---|---|---|
| 2,188,720 | 1/1940 | McQuade | 51/241 B |
| 2,414,731 | 1/1947 | Forbes | 51/241 S |
| 2,587,398 | 2/1952 | Smith | 51/241 S X |
| 2,736,995 | 3/1956 | Richey | 51/241 B |
| 2,801,506 | 8/1957 | Mills | 51/241 S |
| 2,822,650 | 2/1958 | Barrett | 51/241 B |
| 2,869,293 | 1/1959 | Howard | 51/241 B |
| 3,067,651 | 12/1962 | Hogden et al. | 51/241 B X |
| 3,613,320 | 10/1971 | Mighton | 51/290 |
| 4,513,542 | 4/1985 | Wilger et al. | 51/241 S |

OTHER PUBLICATIONS

Wachs Tools for Pipe and Valves, E. H. Wachs Company-Advertisement Supplement two pages-P.T.O. Aug. 19, 1982.

*Primary Examiner*—Frederick A. Schmidt
*Assistant Examiner*—M. Rachuba
*Attorney, Agent, or Firm*—Stanley J. Price, Jr.

[57] ABSTRACT

A grinder assembly includes a grinder support device positioned within a pipe section and has a support shaft extending along the longitudinal axis of the pipe. A grinder is supported from the support shaft by means of a connector secured to the body portion of the grinder. The grinding wheel is positioned in abutting relation with the edge of the pipe and the support shaft being rotatably mounted on the grinder support permits the grinding wheel to rotate around the periphery of the shaft. There is an adjustment device for the support shaft where the angularity of the support shaft, the grinder, the connector and the grinder wheel face can be adjusted angularly relative to the longitudinal axis of the pipe section to compensate for an edge portion of a pipe that is cut at an angle other than perpendicular to the longitudinal axis of the pipe. There is a second adjusting means on the grinder with which the face of the grinding wheel can move relative to the edge of the pipe to compensate for irregularities in the edge of the pipe. The legs supporting the grinder support are adjustable so that the grinder assembly can be used with pipes of differing diameter.

10 Claims, 2 Drawing Sheets

METHOD AND APPARATUS FOR GRINDING THE EDGE OF A PIPE

BACKGROUND OF THE INVENTION

1. Field of the Invention

This invention relates to a grinder assembly and more particularly to a grinder assembly having adjustment means for grinding the circular edge of a pipe.

2. Description of the Prior Art

The gas transmission lines spanning the country are assembled by welding sections of relatively large diameter pipe to form the continuous pipe line. The pipe sections are cut and brought to the job site and frequently are cut at the job site. In cutting the pipe sections, frequently the cutting results in a pipe section that has an edge portion cut at an angle other than perpendicular to the longitudinal axis of the pipe or stated otherwise the end portion of a pipe is nonperpendicular to the longitudinal axis of the pipe section. Also during the cutting operation, frequently the edge of the pipe is not linear in that it has slightly curved or undulating portions. In storage of the pipe sections at the job site and/or transporting them to the job site, the pipe sections are stacked on top of each other and because of the weight certain of the sections are distorted and not perfectly round so that they take on a slight elliptical configuration.

Before the pipe sections are welded to each other, the edges of the pipe are beveled to form a V-shaped groove and the edges also preferably have a flat land portion. The end sections of the pipe are also ground to remove the rust and cleanse the pipe so that a gas tight weld can be made between the sections.

Because of the distorted edges of the pipe sections, presently substantially all of the grinding is done manually to form the V-shaped grooves and lands. This is an expensive and time consuming operation. There is a need for an automated device for grinding the edges of the pipe sections which is adjustable to compensate for the imperfections in the pipe edge sections during the grinding operation.

The prior art discloses abrading machines or grinding machines for grinding pipe flanges, railway journal boxes and ends of pipe sections. For example, U.S. Pat. No. 2,801,506 discloses a jig for grinding journal box surfaces and includes a means to adjust the grinding wheel radially from a guide post. U.S. Pat. No. 2,736,995 discloses a pipe flange grinding machine that also has the grinding wheel adjustable in a radial manner. The assembly is mounted on the pipe flange and secured within the inner portion of the pipe by a support device.

U S. Pat. No. 1,031,934 discloses a grinding machine that is supported within a pipe section by a support means and has a motor driven grinder mounted on a turntable, and a motor mount is adjustable radially.

U.S Pat. No. 2,869,293 discloses a mounting for a pipe end grinder where the grinder is supported by a support means secured within the pipe and has a grinding wheel that is angularly adjustable to the longitudinal axis of the pipe and has a resilient means to urge the grinding wheel against the edge of the pipe.

U.S. Pat. No. 2,188,720 discloses an abrading machine that is supported within the pipe and has grinding wheel mounted thereon that appears to be adjustable radially relative to the longitudinal axis of the pipe.

U.S. Pat. No. 2,587,398 discloses an annular grinding or abrading device that is mounted on a support secured within the pipe section. The annular grinding wheel extends around the periphery of the pipe and is urged against the edge portion and manually rotated to perform the finishing of the pipe edge.

U.S. Pat. No. 2,414,731 discloses a grinding attachment for grinding the end face of a pipe and includes a three leg support within the pipe for the grinder. The grinder has a shaft portion that extends into an axial tube of the support device and is rotatable about the periphery of the pipe edge. In one embodiment, the grinding wheel is adjustable to change the angle of a grinding wheel surface relative to the edge of the pipe to form a bevel thereon.

Although some of the above prior art disclose grinder assemblies for grinding the edge of a pipe, there is a need for a grinder assembly that not only supports the grinder for rotation around the periphery of the pipe edge portion but also for a grinding assembly where the face of the grinder wheel can be adjusted to compensate for pipe edge portions that are cut at an angle other than an exact perpendicular to the longitudinal axis of the pipe and also adjustment means to adjust the grinding wheel for uneven portions of the pipe edge.

SUMMARY OF THE INVENTION

This invention relates to a grinder assembly for grinding the circular edge of a pipe that includes a grinder support device that has a body portion with three legs extending therefrom. The legs of the support device are arranged to abut the inner surface of the pipe. A support shaft is supported by the grinder support device and has an end portion extending therefrom. The support shaft is arranged to extend longitudinally within the pipe. A first adjusting means is provided to angularly adjust the support shaft. A grinder that has a body portion and a rotatable grinding wheel mounted on the body portion is connected to the support shaft by means of a connector extending from the grinder body portion. The connector supports the grinder and permits the grinder to rotate around the entire edge of the pipe. The first adjusting means is arranged to angularly adjust the support shaft of the grinder support device and thus adjust the angular relation between the face of the grinding wheel and the pipe edge portion to permit the grinding wheel face to grind the entire peripheral edge portion of a pipe that has an edge portion cut at an angle other than perpendicular to the longitudinal axis of the pipe.

The invention further includes a second adjusting means to move the grinding wheel relative to the pipe edge portion to maintain a face of the grinding wheel in abutting relation with the edge portion of the pipe to compensate for irregularities and undulations in the linearity of the pipe edge portion.

The leg portions of the grinder support device are also adjustable to permit the assembly to be used with pipes of different diameters and provide the support device with a support shaft extending along the longitudinal axis of the pipe.

DESCRIPTION OF THE PREFERRED EMBODIMENTS

Figure 1:
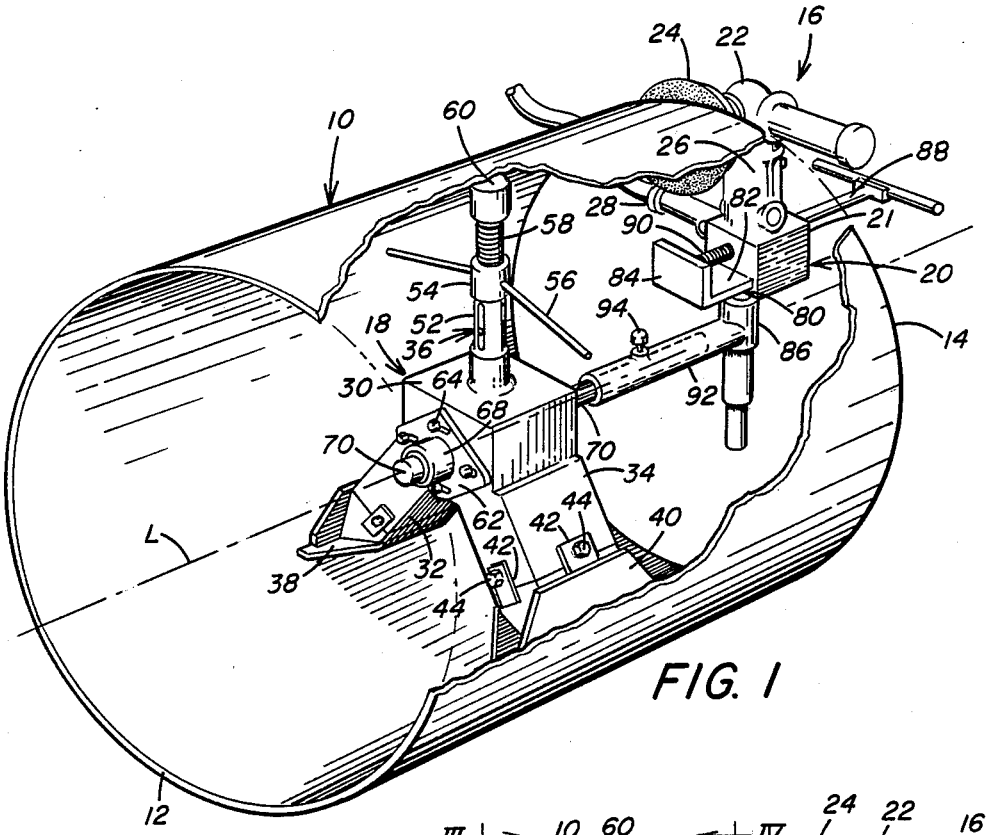
FIG. 1 is a view in perspective of the grinding machine positioned in a pipe section with a portion of the pipe broken away to illustrate the manner in which the grinding machine is supported within the pipe section.
Figure 2:
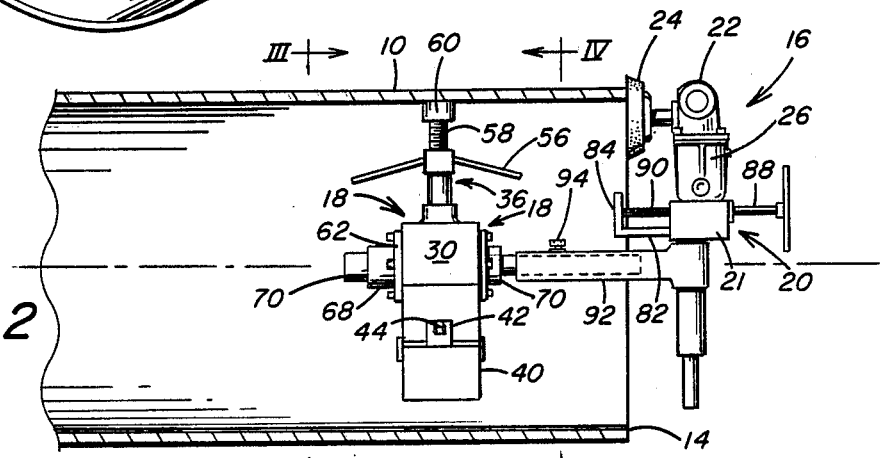
FIG. 2 is a view in horizontal section of the end of a pipe section with the grinding machine mounted therein.

Referring to the drawings, there is illustrated a pipe section generally designated by the numeral 10 which has a first end or edge portion 12 and a second end or edge portion 14. The pipe sections 10 are precut either at the location where the pipe is being installed or precut at another location and transported to the location where the pipe is to be installed. The sections 10 come in different lengths and are stacked prior to use so that certain of the sections may be slightly distorted into an elliptical shape and frequently in cutting the sections either at the job site or at another location the end portions of the pipe sections are not exactly perpendicular to the longitudinal axis of the pipe section. The edge portions of the pipe may also be nonlinear and have undulations that make it difficult to grind a uniform bevel and land. The non-perpendicular cut is diagrammatically and in an exaggerated manner illustrated in FIG. 8 where the pipe section end portion 14 deviates from the perpendicular by the angle -a- from a perpendicular plane. The pipe sections 10 are first ground by a grinding device which, where desired, provides a V-shaped bevel in abutting end portions of the pipe and a flat land may also be formed by the grinder. During installation, the lands are in abutting relation and the V-shaped bevel is filled with metal by welding to secure the ends of the pipe to each other in a gas tight manner and form a continuous pipe line of pipe sections.

It is essential that the ends of the pipes be ground and beveled to provide a circumferential weld to connect the pipe sections and seal the joint therebetween.

A grinding machine assembly generally designated by the numeral 16 is positioned in the end of the pipe section and has a grinder support portion 18 within the pipe and a grinder adjusting section 20 which is arranged to be positioned externally of the pipe. The grinder section 20 has a body portion 21 and a conventional grinder 22 with a grinding wheel 24 and a grinding wheel rotating device 26. The grinder wheel 24 is preferably driven through the grinding wheel rotating device 26 by air under pressure entering through inlet 28.

The grinder support 18 has a body portion 30 with a pair of angularly extending legs 32 and 34 and an adjustable leg 36. The legs 32 and 34 are secured to the body portion 30 and have engaging feet 38 and 40 which are arranged to abut the inner surface of the pipe. The feet 38 and 40 have plurality of strap portions 42 secured thereto and extending upwardly therefrom. The strap portions 42 are secured to the respective legs 32 and 34 by bolts 44 which are received in threaded portions of the legs 32 and 34.

Figure 10:
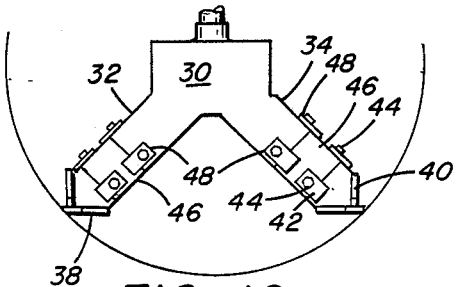
FIGS. 10 and 11 are fragmentary views in front elevation of the support legs for the grinding machine support device illustrating the adjustability of the legs for different diameter pipes.
Figure 11:
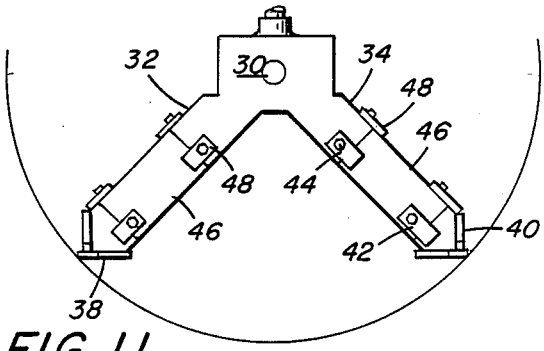

As illustrated in FIGS. 10 and 11, the legs 32 and 34 can be extended by means of segments 46 positioned between the ends of the legs 32 and 34 and the feet 38 and 40. The segments 46, as in FIGS. 10 and 11, have different lengths so that the grinder support 18 may be positioned in different diameter pipes. The segments 46 have threaded bolt receiving apertures adjacent their base portion to receive the bolts to secure the segments to the feet 38 and 40. The segments 46 also have straps 48 extending upwardly therefrom which overly the threaded apertures in the leg portions 32 and 34 and receive bolts to secure the segments 46 to the legs 32 and 34. The segments are so dimensioned that the longitudinal axis of the support body portion 30 is aligned with the longitudinal axis of the pipe section. The longitudinal axis of the pipe section is designated in the FIGURES by the letter "L".

The third leg portion 36 of the grinder support 18 has a cylindrical upstanding portion 52 with a cylindrical cap 54 mounted thereon. The cap 54 has an internally threaded portion and a pair of arms 56 extending therefrom. The leg 36 has a threaded rod 58 extending through the threaded cap 54 and a foot portion 60. The length of the leg 36 may be increased or decreased by rotating the arms 56 to move the threaded portion of rod 58 downwardly or upwardly in the threaded cap 54. With this arrangement, the grinder support 18 may be positioned in pipes of different diameter by extending or retracting leg 36 and utilizing the segments 46 as previously discussed.

Figure 3:
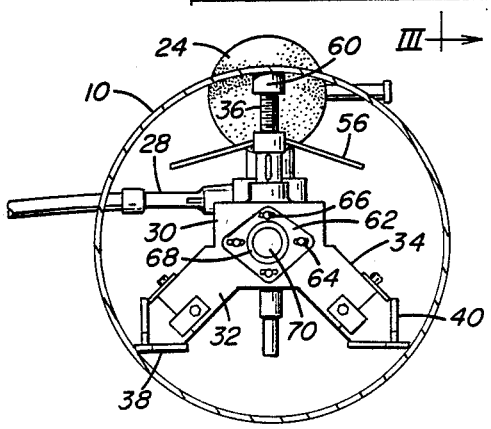
FIG. 3 is a rear end view taken along the lines III—III of FIG. 2.
Figure 4:
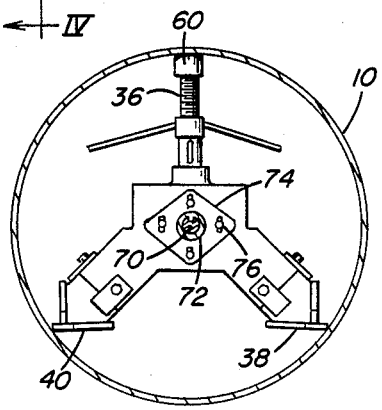
FIG. 4 is an end view of the support portion of the grinding machine taken along the lines IV—IV of FIG. 2.
Figure 5:
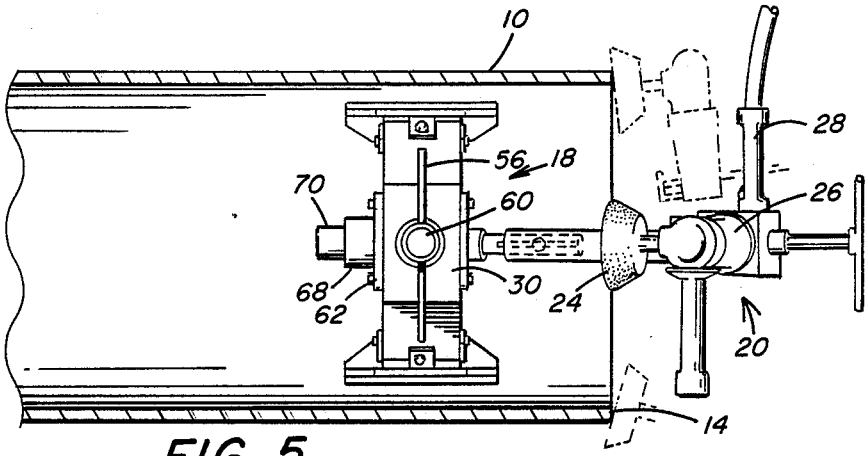
FIG. 5 is a view similar to FIG. 4 illustrating the manner in which the grinding wheel portion of the grinding machine is adjusted angularly to provide a bevel on the end of the pipe section.
Figure 6:
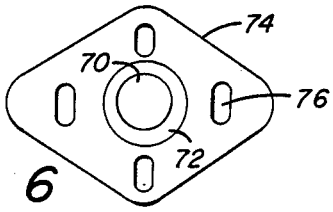
FIGS. 6 and 7 are fragmentary views in elevation of the pillow blocks secured to the grinding machine support device which are adjustable vertically and horizontally to change the angle of the support shaft as illustrated in FIG. 5.
Figure 7:
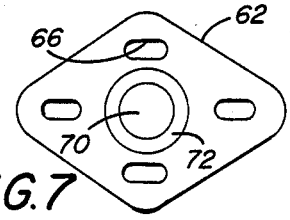

The body portion 30 of grinder support 18 has a general box like configuration and has a first pillow block member 62 secured thereto by bolts 64. The bolts 64 extend through elliptical receiving apertures 66 illustrated in FIG. 7. Mounted in the pillow block 62 is a spherical bearing 68. A shaft 70 is mounted in the spherical bearing 68. The mounting of the pillow block 62 is clearly illustrated in FIG. 3 with the horizontal slotted apertures 66 for the bolts 64. Similarly, the shaft 70 is rotatably mounted in a spherical bearing 72 in pillow block 74 (FIGS. 4 and 6). The pillow block 74 has vertical slots 76 therein which permits the vertical adjustment of the pillow block 74 relative to the body portion 30 of grinder support 18. The shaft 70 has an end portion extending outwardly from the grinder support body portion 30.

The grinder 22 has an air motor 26 that is arranged to utilize air under pressure supplied through the inlet 28 to rotate the grinding motor 26 and rotate the grinding wheel 24. The motor 26 is mounted on a grinder adjusting section or body portion 21. The body portion 21 as in turned rail portions 80 on which is mounted a slidable plate 82. The slidable plate 82 has an up turned end flange 84 and a connector 86 is secured to the underside of plate 82. The grinder body portion 21 has a threaded adjusting bar 88 extending through receiving threads therein and end portion 90 of bar 88 abuts the upstanding flange 84. With this arrangement, rotation of threaded adjusting bar 88 moves the grinding machine assembly 16 toward and away from the grinder support 18 to adjust the relative position of a face of the grinding wheel 24 relative to the pipe edge 14. The connector 86 has an outwardly extending tubular member 92 and the end portion of shaft 70 extends into the tubular member 92 and is secured therein by nut 94. With this arrangement, the grinding machine assembly 16 is rotatably supported on the rotatable shaft 70 extending from the body portion 30 of grinder support 18.

Figure 8:
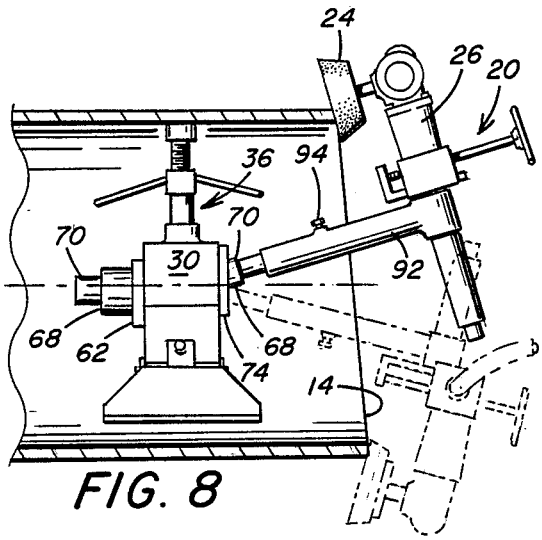
FIGS. 8 and 9 are sectional views similar to FIG. 5 illustrating an edge portion of a pipe that is nonperpendicular to the longitudinal axis of the pipe and the manner in which the grinding portion of the machine is adjusted so that it can grind the bevel on the non-perpendicular edge of the pipe.
Figure 9:
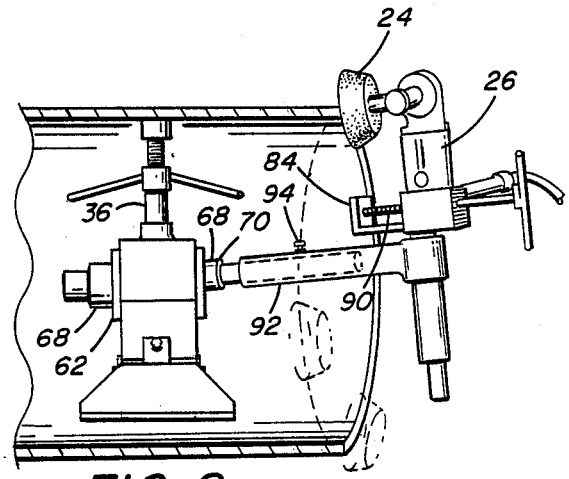

The grinder assembly operates in the following manner. The grinder support 18 is positioned with the pipe 10 with the feet 38 and 40 abutting the inner surfaces of the pipe. The threaded rod 58 is extended by rotating the arms 56 so that the foot portion 60 also abuts the inner surface of the pipe. With this arrangement, the support member having the preselected leg segments 46 positioned thereon and extending the threaded rod 58 into abutting relation with the pipe inner wall secures the grinder support with the rotatable shaft 70 extending coaxially with the longitudinal axis of the pipe 10.

Where the pipe edge portion is cut at an angle other than perpendicular to the longitudinal axis of the pipe, the bolts 64 securing one of the respective pillow blocks 62 and 74 are loosened and either one or both cf the pillow blocks 62 and 74 are adjusted either vertically or horizontally to adjust the longitudinal axis of the shaft 70 relative to the longitudinal axis of the pipe section 10 to compensate for the nonperpendicular edge portion of the pipe section. FIGS. 8 and 9 are exaggerated views of the angular deviation of the shaft 70 relative to the longitudinal axis of the pipe section. With this arrangement, the face of the grinding wheel 24 will travel in a noncircular path relative to the pipe section longitudinal axis and compensate for the non-perpendicular angle of the edge portion. With this adjusting means, it is now possible to grind a uniform bevel and land on the edge of either a noncircular pipe section or a pipe section cut at an angle other than perpendicular to the longitudinal axis of the pipe.

Where the pipe has nonlinear sections in the edge portion formed by a nonlinear cut of the pipe section, the face of the grinding wheel may be adjusted during its rotation around the periphery of the edge portion to move inwardly and grind a bevel on a nonlinear undulating portion of the pipe by rotating the threaded bar 88 and moving the grinder machine assembly relative to the support shaft 70.

With the above-described grinder assembly, it is now possible to accurately grind a bevel and a face or land on an edge portion of a pipe section cut perpendicular to the longitudinal axis of the pipe. With the adjusting device for the shaft 70, the same apparatus may be utilized to grind a bevel and land on an edge portion of a pipe that is cut at an angle other than perpendicular to the longitudinal axis of the pipe. Further where the edge portion of the pipe section is not linear and undulates, a bevel and land can be formed in the peripheral edge portion of the undulating portion by moving the grinder assembly into abutting relation with the undulating portions of pipe edge.

It should be understood the drawings are for illustrative purposes only and angular deviations such as that illustrated in FIGS. 8 and 9 are not conventional and much smaller angular deviations are usually present in the edges of the pipe end sections. Further, the undulations in the pipe edge sections are relatively small and yet require grinding of a bevel and a land to provide a sealed weld around the peripheral between pipe sections.

According to the provisions of the Patent Statutes, I have explained the principal, preferred construction and mode of operation of my invention and have illustrated and described what I now consider to be its best embodiment. However, it should be understood that, within the scope of the appended claims, the invention may be practiced otherwise than as specifically illustrated and described.

I claim:

1. A grinder assembly for grinding the circular edge of a pipe comprising, a grinder support device having a body portion and three legs extending therefrom, said three legs arranged to abut the inner surface of a pipe, a support shaft supported in said grinder support device and having an end portion extending therefrom, said support shaft arranged to extend longitudinally within said pipe, a first adjusting means to angularly adjust said support shaft, said first adjusting means having a pair of bearing pillow blocks secured to opposite sides of said grinder support body portion with said support shaft rotatably mounted therein, means to move said pillow blocks to adjust the axis of said support shaft relative to the axis of said pipe, a grinder having a body portion and a rotatable grinding wheel mounted thereon, a connector extending from said grinder body portion, said connector secured to said support shaft to support said grinder from said grinder support shaft and permit said grinder to rotate around the entire edge of the pipe, and said first adjusting means arranged to adjust the angular relation between said face of said grinding wheel and said pipe edge portion to permit said grinding wheel face to grind the entire circular edge portion of a pipe.

2. A grinder assembly for grinding the circular edge of a pipe as set forth in claim 1 which includes, second adjusting means to move said grinder relative to the pipe edge portion to maintain a face of said grinding wheel in abutting relation with the edge portion of the pipe.

3. A grinder assembly for grinding the circular edge of a pipe as set forth in claim 1 in which said first adjusting means pair of pillow blocks include, spherical bearings mounted therein, one of said pillow blocks having a plurality of elliptical connector apertures extending vertically thereon and the other of said pillow blocks having elliptical connector apertures extending horizontally thereon, said pillow blocks secured by bolts to opposite sides of said grinder support body portion with said support shaft rotatably mounted in said spherical bearing, the axis of said support shaft arranged to be adjusted in one direction by movement of said pillow blocks on said body portion and in another direction by movement of the other of said pillow blocks on said body portion.

4. A grinder assembly for grinding the circular edge of a pipe as set forth in claim 2 in which said second adjusting means includes, means mounted on said grinder body portion to move said grinder body portion longitudinally relative to said connector and move said grinding wheel face relative to said pipe edge portion.

5. A grinder assembly for grinding the circular edge of a pipe as set forth in claim 2 in which said second adjusting means includes, a horizontal plate member secured to said connector and a vertical plate connected to said horizontal plate member, said grinder body portion slidably mounted on said horizontal plate member, an adjusting screw extending through a threaded bore in said grinder body portion and having an end portion abut said vertical plate so that rotation of said adjusting screw moves said grinder body portion relative to said horizontal plate.

6. A grinder assembly for grinding the circular edge of a pipe as set forth in claim 1 which includes, means to adjust the length of said three legs extending from said grinder support device so that said grinder support device is arranged to rotatably support said grinder on the longitudinal axis of different diameter pipes.

7. A grinder assembly for grinding the circular edge of a pipe as set forth in claim 6 in which, two of said legs each include a foot portion arranged to abut the inner surface of the pipe and leg portions connected to said support member body portion and said foot portion, means to disconnect said foot portion from said leg portion on both of said legs and connect and insert extensions therebetween to increase the overall length of said two legs.

8. A method of grinding the circular edge of a pipe comprising, positioning a grinder support device having a body portion with a support shaft extending therefrom in a pipe having a circular edge portion, mounting said support shaft in a pair of pillow blocks secured to opposite sides of said grinder support body portion, connecting a grinder having a rotatable grinding wheel, a body portion and a connector to said support shaft so that said grinding wheel has a face portion abutting the edge of said pipe, and moving said pillow blocks on said grinder support body portion to adjust the angle of said support shaft to adjust the angular relation between the face of said grinding wheel and said pipe edge portion to permit said grinding wheel face to grind the entire circular edge portion of a pipe.

9. A method of grinding the circular edge of a pipe as set forth in claim 8 which includes, adjusting said grinder relative to said pipe edge portion to maintain a face of said grinding wheel in abutting relation with the surface of the pipe edge portion.

10. A grinder assembly for grinding the circular edge of a pipe comprising, a grinder support device having a body portion and three legs extending therefrom, said three legs arranged to abut the inner surface of a pipe, a support shaft supported in said grinder support device and having an end portion extending therefrom, said support shaft arranged to extend longitudinally within said pipe, a first adjusting means to angularly adjust said support shaft, a grinder having a body portion and a rotatable grinding wheel mounted thereon, a connector extending from said grinder body portion, said connector secured to said support shaft to support said grinder from said grinder support shaft and permit said grinder to rotate around the entire edge of the pipe, and said first adjusting means arranged to adjust the angular relation between said face of said grinding wheel and said pipe edge portion to permit said grinding wheel face to grind the entire circular end portion of a pipe having an edge portion cut at an angle other than perpendicular to the longitudinal axis of the pipe.

* * * * *